United States Patent [19]

Ii et al.

[11] Patent Number: 4,969,840

[45] Date of Patent: Nov. 13, 1990

[54] ELECTRICAL CONNECTOR FOR FLEXIBLE FLAT CABLE

[75] Inventors: Hidehiro Ii, Yokohama; Tsunehiro Takahashi, Yamato; Hiroyuki Sekine, Sagamihara; Kouichi Asakura, Tokyo, all of Japan

[73] Assignee: Molex Incorporated, Lisle, Ill.

[21] Appl. No.: 492,683

[22] Filed: Mar. 12, 1990

[30] Foreign Application Priority Data

Mar. 15, 1989 [JP] Japan ..... 1-029688

[51] Int. Cl.[5] ..... H01R 9/07

[52] U.S. Cl. ..... 439/495; 439/77; 439/352

[58] Field of Search ..... 439/492–499, 439/67, 77, 325–328, 352, 354

[56] References Cited

U.S. PATENT DOCUMENTS

| | | | |
|---|---|---|---|
| 4,172,626 | 10/1979 | Alsson | 439/495 |
| 4,191,441 | 3/1980 | Ryder et al. | 439/77 |
| 4,265,507 | 5/1981 | Johnson | 439/495 |
| 4,480,886 | 11/1984 | Bergamin | 439/492 |
| 4,629,271 | 12/1986 | Awano | 439/77 |
| 4,705,482 | 11/1987 | Endo et al. | 439/492 |

FOREIGN PATENT DOCUMENTS

| | | | |
|---|---|---|---|
| 234780 | 9/1987 | European Pat. Off. | 439/499 |

*Primary Examiner*—David L. Pirlot

*Attorney, Agent, or Firm*—Louis A. Hecht; Stephen Z. Weiss; Charles S. Cohen

[57] ABSTRACT

Disclosed is an electrical connector for a flexible flat cable comprising a connector housing having a plurality of terminals arranged therein and a connector cover removably mounted on the connector housing. The connector cover has a pressure blade which displaces each terminal thereby resiliently holding flat conductors on the cable between a contact portion of each terminal and the blade as well as electrically connecting the flat conductors and the contact portions of the terminal. The flexible flat cable is provided with a lock hole between the flat conductors thereon and a lock plate having a projection in a free end thereof mounted between the terminals. In addition, a support blade is mounted under the pressure blade of the connector cover. When the flexible flat cable is inserted and the connector cover is pushed into the connector housing, the lock hole of the cable becomes engaged with the projection of the lock plate.

6 Claims, 4 Drawing Sheets

ELECTRICAL CONNECTOR FOR FLEXIBLE FLAT CABLE

BACKGROUND OF THE INVENTION

1. Field of the Invention

The present invention relates to an electrical connector for a flexible flat cable, and more specifically to an improved electrical connector for flat flexible cables referred to as "FFC" or flexible printed circuit refereed to as "FPC", which ensures a completely inserted condition for the cable when each conductor on the cable is electrically connected to each terminal in said electrical connector.

2. Description of the Prior Art

As is already known in the art, various types of FFC or FPC cables as stated above and many kinds of electrical connectors for connecting the respective conductors on such cables to the respective terminals which have lead wires coupled thereto, or to the respective terminals which are coupled to conductors on printed circuit boards are extensively utilized.

These prior art electrical connectors comprise a connector housing having a plurality of terminals arranged in parallel therein with a flexible flat cable being inserted into an insertion space defined between contact portions of said terminals and an upper wall of said connector housing. Then each of a plurality of flat conductors on the exposed end portion of said flexible flat cable is resiliently held between the upper wall of the connector housing and each of the contact portions of the terminals, thereby completing an electrical connection therebetween.

Although the prior art electrical connectors have an advantage in that they are simple in construction and easy to manufacture, they lead to a significant deficiency in that detachment of the flexible flat cable from the connector is likely to occur because means for preventing such detachment includes the resilient holding force of the terminals. To increase the ability of these prior art connectors to prevent detachment, the force of the terminals on the cable must be increased. But there are problems in increasing this force.

An electrical connector which overcomes the above deficiencies has been proposed in Japanese Utility Model Laid Open No. 129286-1986. As disclosed therein, the electrical connector for a flexible flat cable comprises a connector housing having a plurality of terminals arranged therein at predetermined intervals in parallel, and a connector cover removably mounted on said connector housing and having a pressure blade capable of being inserted into a space defined between an undersurface of an upper wall of said connector housing and a contact portion of each terminal. A flexible flat cable having a plurality of flat conductors arranged thereon at predetermined intervals in parallel is completely inserted through an insertion port of said connector cover into said space. After cable insertion, said pressure blade of the connector cover is pushed into a completely inserted position within said space so that said pressure blade of the connector cover serves to displace each terminal. This causes the flat conductors on said cable to be resiliently held between said contact portion of each terminal and said blade thereby electrically connecting said flat conductors and said contact portions of said terminals.

According to the arrangement as stated above, at the time of insertion of the flexible flat cable, because the contact portion of the terminal is not resiliently pushed against the under surface of the upper wall of the connector housing, the cable is freely inserted into an open insertion space with a low insertion force. The pressure blade causes the downward deflection of the terminal to increase the resilient force thereof, thereby resiliently holding the conductors on the flexible flat cable between the contact portion of the terminal and the pressure blade consequently assuring the completely inserted position for the flexible flat cable.

It is to be noted, however, that in the above connector arrangement, because the flexible flat cable is being held in the completely inserted position only with the resilient force of the terminal, it is desirable to provide the connector with a more efficient means for preventing the detachment of the cable, especially where the electrical connector for connecting the flexible flat cable and the terminal is moved, as for example, where the electrical connector is used with movable parts.

SUMMARY OF THE INVENTION

In view of the foregoing, it is an object of the present invention to provide an electrical connector which comprises means for reliably assuring a completely inserted condition for a flexible flat cable, in addition to simply holding the cable by a resilient force of the terminal. When the flexible flat cable is inserted into the completely inserted position within a connector housing, each exposed flat conductor on the cable is resiliently held between a pressure blade and a contact portion of the terminal, thereby completing the electrical connection therebetween.

It is another object of the present invention to provide an electrical connector including means for locking a flexible flat cable within a connector housing and preventing the cable from detaching therefrom by using the insertion operation without the need for a specific locking operation.

It is a further object of the present invention to provide an electrical connector which comprises means for realizing a low insertion force for a flexible flat cable and for effecting a temporary holding of the flexible flat cable while pushing the cable into a completely inserted position.

In order to achieve the above objects, the present invention provides an electrical connector for a flexible flat cable comprising a connector housing 1 having a plurality of terminals 2 arranged therein at the predetermined intervals in parallel, and a connector cover 3 removably mounted on said connector housing 1 and having a pressure blade 30 capable of being inserted into a space 24 defined between an undersurface of an upper wall 5 of said connector housing 1 and a contact portion 14 of each terminal 2. The flexible flat cable 4 having a plurality of flat conductors 38 arranged thereon at the predetermined intervals in parallel is entirely inserted through an insertion port 28 of said connector cover 3 into said space 24. Thereafter, pressure blade 30 of the connector cover 3 is pushed into a completely inserted position within said space 24 so that said pressure blade 30 of the connector cover 3 displaces each terminal 2, thereby resiliently holding said flat conductors 38 on said cable 4 between said contact portion 14 of each terminal 2 and said blade 30 and electrically connecting said flat conductors 38 and said contact portions 14 of said terminals 2.

The invention is further characterized in that the flexible flat cable 4 is processed to have a lock hole 40 between said flat conductors 38 thereon; a lock plate 15 having a projection 18 on a free end thereof being mounted between said terminals 2 in said connector housing 1 so that said projection 18 of said lock plate 15 is fit into said lock hole 40 of said flexible flat cable 4 at said completely inserted position; and a support blade 34 being mounted at the position under said pressure blade 30 of said connector cover 3 and at the same level as that of said lock plate 15 for abutting and preventing the downward deflection of said lock plate 15 at said completely inserted position.

According to the electrical connector described above, at the time before the flexible flat cable 4 is connected to the terminal 2, the connector cover 3 is positioned in a withdrawn position, i.e., in an insertion start position. Then the flexible flat cable 4 is entered through the insertion port 28 of the connector cover 3 into the insertion space 24 of the connector housing 1. While inserting the flexible flat cable 4, it contacts the projection 18 defined on the upper surface of the free end of the lock plate 15 and it is guided thereby to reach the completely inserted position.

As the flexible flat cable 4 is guided by said projection 18, the lock plate 15 is downwardly deflected to store the resilient force therefor which causes the upward movement of the flexible flat cable 4, thereby temporarily holding the cable 4. When the flexible flat cable 4 reaches the predetermined position, the lock hole 40 is partially engaged with the projection 18. It is to be noted that at the beginning of the insertion of the flexible flat cable, the terminal 2 in the insertion space 24 is not resiliently contacted against the under surface of the upper wall 5 of the connector housing 1, which realizes a low insertion force for the flexible flat cable.

Then the connector cover 3 is pushed into the completely inserted position. The pressure blade 30 causes a downward displacement of the flexible flat cable 4 against terminal 2, thereby resiliently holding each flat conductor 38 on the flexible flat cable 4 between each terminal 2 and the pressure blade 30 corresponding to said terminal 2, and completing the electrical connection therebetween.

According to the characteristic feature of the present invention, the lock hole 40 of the flexible flat cable 4 is perfectly engaged with the projection 18 on the upper surface of the free end of the lock plate 15 at the completely inserted position, thereby reliably preventing them from detaching to each other. Also at this completely inserted position, the support blade 34 of the connector cover 3 is positioned under the lock plate 15 and serves to support the plate 15 from underside thereof. This prevents the downward deflection of the lock plate 15 to insure the reliable connection between the flexible flat cable and the terminal. At this time the lock plate 15 is held substantially horizontal and the flexible flat cable 4 is horizontally positioned on the upper surface 22 of the lock plate 15 with the projection 18 engaged with the lock hole 40 of the cable.

BRIEF DESCRIPTION OF THE DRAWINGS

The present invention will be described in conjunction with the preferred embodiment as shown in the accompanying drawings in which:

FIG. 5 shows a relationship between the flat conductors on the flat cable and the contact portions of the terminals, taken along a line 5-5 in FIG. 4, and FIG. 6 shows a relationship between the flexible flat cable and the lock plate, taken along a line 6-6 in FIG. 4; FIG. 7 shows a relationship between the flat conductors on the flat cable and contact portions of the terminals, and FIG. 8 shows a relationship between the flexible flat cable and the lock plate.

DESCRIPTION OF THE PREFERRED EMBODIMENT

Reference is now made to an electrical connector for a flexible flat cable having two flat conductors thereon, constructed in accordance with the preferred embodiment of the present invention which is intended for connection with two terminals which then connect to two lead wires, respectively.

Figure 1:
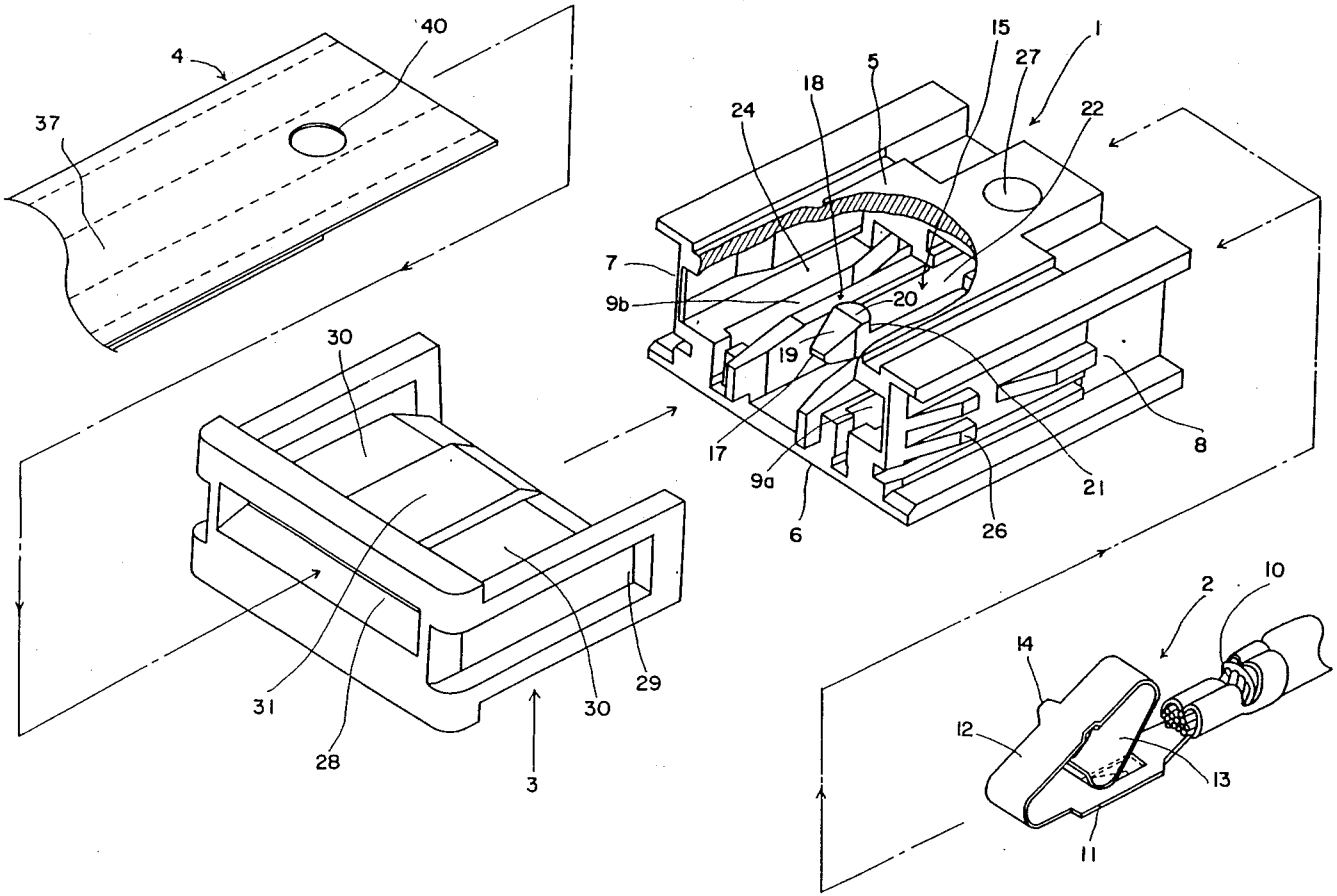
FIG. 1 is perspective view of an electrical connector according to the present invention, representing the positional relationship between a connector housing, terminals, a connector cover and a flexible flat cable.
Figure 2:
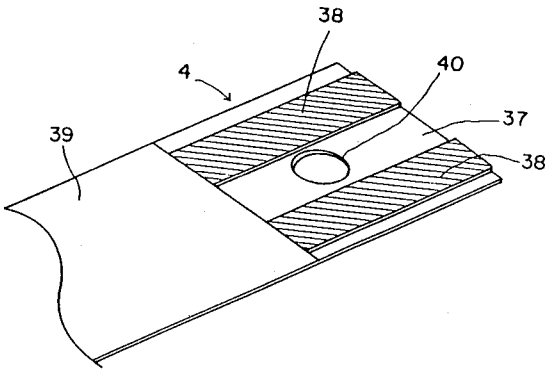
FIG. 2 is a partial view of the flexible flat cable with an end portion thereof removed in order to reveal the flat conductors.
Figure 4:
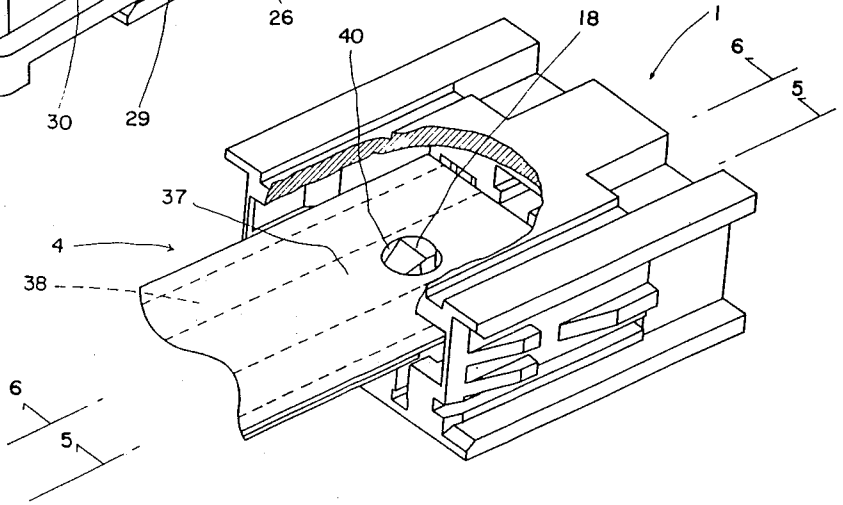
FIG. 4 shows an engagement of the flat cable with a projection defined on a free end of a lock plate of the connector housing with the connector cover removed for the sake of clarity.
Figure 3:
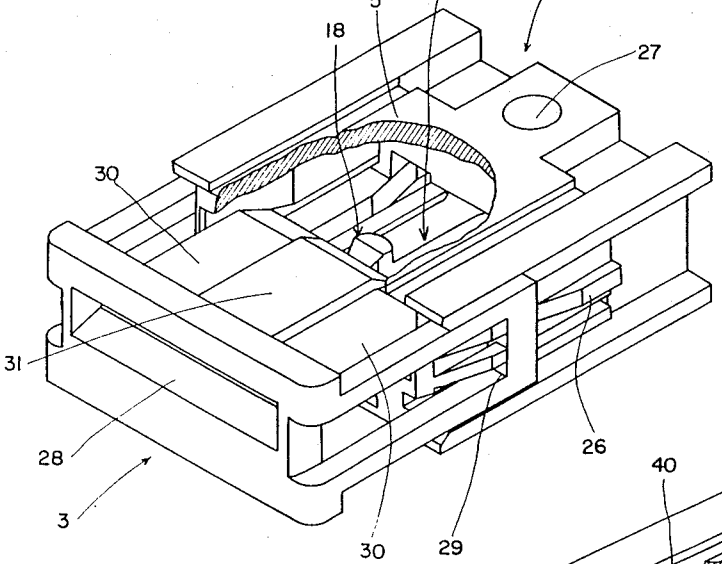
FIG. 3 shows the connector cover mounted on the connector housing in the insertion start position.

FIG. 1 is a perspective view of the electrical connector, representing the positional relationship between a connector housing 1, one of the terminals 2 which are to be mounted in each terminal mounting cavity of said connector housing 1, a connector cover 3 which is engaged with and disengaged from the connector housing 1, and a flexible flat cable 4. FIG. 2 is a sectional view of the flexible flat cable 4 with an end portion thereof removed in order to reveal the flat conductors. FIG. 3 shows the electrical connector at the time before the connector cover 3 is mounted on the connector housing 1 (which has no terminals mounted) and is pushed thereinto, namely the connector cover 3 is in an insertion start position. FIG. 4 shows an engagement of a lock hole of the flexible flat cable 4 with a projection defined on a free end of a lock plate of the connector housing 1 when the flexible flat cable 4 is inserted into a completely inserted position in the connector housing 1, with the connector cover removed for the sake of clarity.

Figure 5:
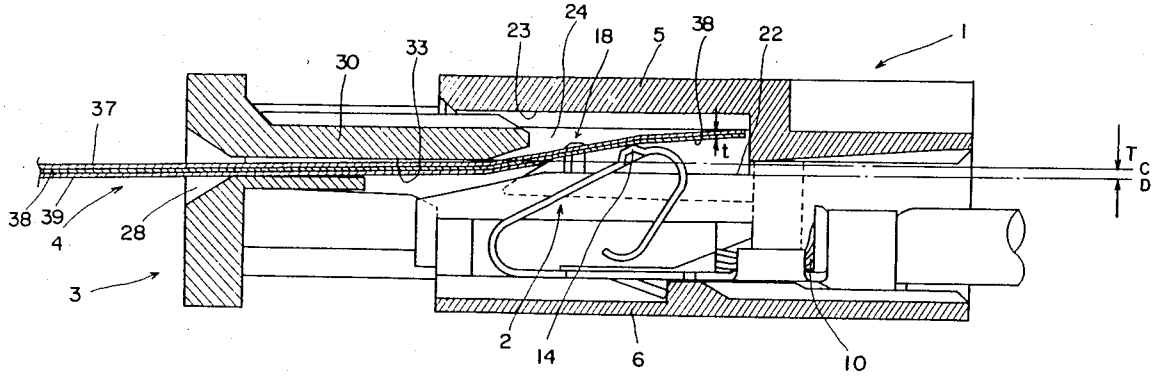
FIGS. 5 and 6 show the electrical connector according to the present invention under such condition that the connector cover is in the insertion start position: more specifically.
Figure 6:
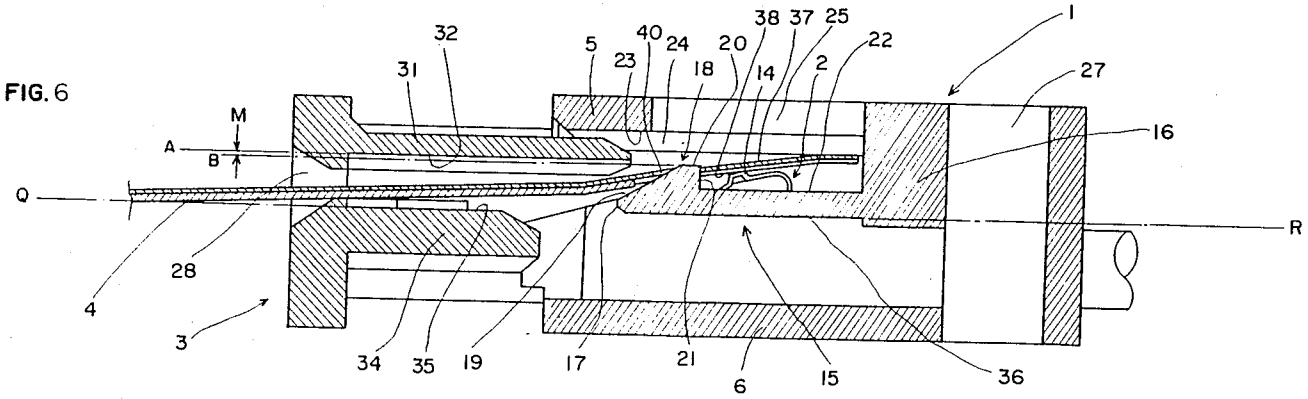
Figure 7:
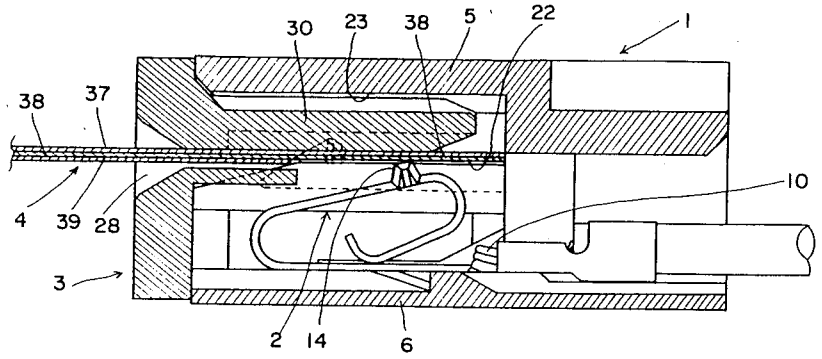
FIGS. 7 and 8 show the electrical connector according to the present invention under such condition that the connector cover is in a completely inserted position: more specifically
Figure 8:
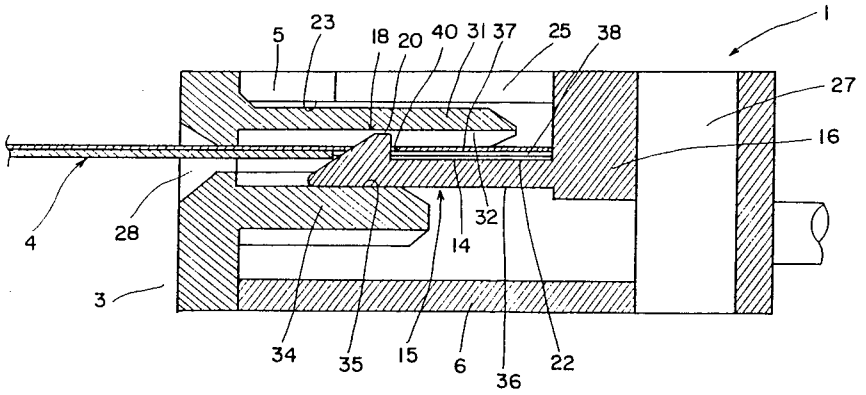

FIGS. 5 and 6 show the electrical connector according to the present invention under the insertion start condition at the time before the connector cover 3 is pushed thereinto. FIG. 5 shows a relationship between the flat conductors on the flat cable and the terminals. FIG. 6 shows a relationship between the flexible flat cable and the lock plate. FIGS. 7 and 8 show the electrical connector under such condition that the connector cover is in a completely inserted position. FIG. 7 shows a relationship between the flat conductors on the flat cable and terminals. FIG. 8 shows a relationship between the flexible flat cable and the lock plate.

With reference to these figures, the connector housing 1 comprises upper and lower walls 5 and 6, as well as side walls 7 and 8. These walls define two internal terminal mounting cavities 9a and 9b with a predetermined space therebetween. Said two terminal mounting cavities 9a and 9b are intended for mounting of terminals 2 therein. The terminal 2 comprises a flat portion 11 connected to conductors 10 of insulated wire; a portion 12 which is integral with said flat portion 11 and is upwardly and obliquely bent therefrom; and a portion 13 which is internally bent from said inclined portion 12. A contact portion 14 is formed on said inclined portion 12.

In the arrangement thus described, each terminal 2 is inserted into the respective terminal mounting cavities 9a and 9b with its contact portion 14 facing up and having such resiliency that when the contact portion 14 is depressed downwardly, the inclined portion 12 is downwardly deflected to produce a repulsive force. A lock plate 15 is disposed between said two terminals 2 and linearly and horizontally extends from a rear wall 16 of the connector housing 1. The lock plate 15 is formed with a free end portion 17 having a projection 18 at its upper surface. The projection 18 includes an forwardly inclined wall 19, an upper surface 20 and a rear vertical wall 21 which orthogonally intersects the upper surface 22 of the lock plate 15. More specifically two terminals 2 are spaced to each other within the connector housing 1 and the lock plate 15 is positioned between the terminals 2 with the projection 18 forwardly facing. At the time before the flexible flat cable 4 is inserted, the contact portion 14 of the terminal 2 is positioned above the upper surface 22 of the lock plate 15 without contact thereto because of no deformation of said contact portion 14. This provides for insertion of the flexible flat cable 4 in space 24 as defined by said contact portion 14 and a bottom surface 23 of the upper wall 5. The upper wall 5 is provided with a release window 25 at the position of corresponding to the lock plate 15. The side walls 7 and 8 are provided with male portions 26 for locking the connector cover 3. The rear wall 16 is provided with a mounting hole 27 vertically extending therethrough.

Connector cover 3 is provided with an insertion port 28 for receiving the flexible flat cable 4 at the front side thereof and female portion 29 intended for engagement with said male portions 26 of the connector housing 1 at the right and left hand sides thereof. The connector cover is also provided with two pressure blades 30 at the positions corresponding to the terminals 2 within the connector housing 1. In addition a coupler member 31 for integrally coupling these two pressure blades 30 is disposed at the position corresponding to the upper side of the lock plate 15 within the connector housing 1. When the pressure blades 30 of the connector cover 3 are inserted into the insertion space 24 of the connector housing 1, said coupler member 31 is positioned above the lock plate 15 of the connector housing 1, and because of the coupler member 31 having a concave bottom surface 32, the relationship between the height level "A" of the bottom surface 32 and the height level "B" of upper surface 20 of the projection 18 of the horizontal lock plate 15 is defined in such manner that the level "A" is slightly higher than the level "B" by "M". In the same manner as described above, when the pressure blades 30 of the connector cover 3 are inserted into the insertion space 24 of the connector housing the relationship between the height level "C" of the bottom surfaces 33 of the pressure blades 30 and the height level "D" of the upper surface 22 of the horizontal lock plate 15 is defined in such manner that the level "C" is slightly higher than the level "D" by "T". This "T" is approximately equal to the thickness t of the flexible flat cable. Specifically, the connector cover 3 is provided with a support blade 34.

Said support blade 34 is arranged at the position under the insertion port 28 and opposite to the coupler member 31. The length of the support blade 34 is determined in such a manner that the lock plate 15 can downwardly be deflected when the pressure blade 30 of the connector cover 3 is in insertion start position. In other words, only when the pressure blade 30 is inserted into the completely inserted position, is the support blade 34 positioned under the lock plate 15, thereby preventing the downward deflection of the lock plate 15. The height level "Q" of the upper surface 35 of the blade 34 is approximately equal to the level "R" of bottom surface 36 of the lock plate 15.

The flexible flat cable 4 comprises an upper insulation layer 37, flat conductors 38 and a lower insulation layer 39. The flexible flat cable 4 is treated such that the lower insulation layer 39 is removed at the end portion of the cable 4 to reveal the flat conductors 38. The lock hole 40 is formed therebetween.

The operation of the electrical connector arranged in the manner as stated above will now be described.

Referring to FIGS. 5 and 6, when the connector cover 3 is in the insertion start position, the flexible flat cable 4 is entered through the insertion port 28 of the connector cover 3. Then the flexible flat cable 4 is completely inserted into the insertion space 24 while being guided by the inclined surface 19 and the upper surface 20 of the projection 18 of the lock plate 15. In this operation the lock plate 15 is slightly and downwardly deflected. This is because the support blade 34 of the connector cover 3 is not positioned under the lock plate 15 at this time. Therefore the lock plate 15 produces a repulsive force to upwardly move the flexible flat cable 4. When the flexible flat cable 4 is inserted to the predetermined position, the lock hole 40 of the cable 4 is partially mated with the projection 18 of the lock plate 15, thereby temporarily holding the flat cable 4 in position. It is important to note that according to the arrangement of the insertion space 24 as described above, initially the contact portion 14 of the terminal 2 is not resiliently engaged with the bottom surface 23 of the upper wall 5 of the connector housing 1. A clearance is present therebetween, with the result that the low insertion force for the flexible flat cable 4 is realized.

When the connector cover 3 is inserted deeply into the connector housing 1, namely into the completely inserted position, the female portion 29 of the connector cover 3 and the male portion 26 of the connector housing 1 are mated to each other. FIGS. 7 and 8 show such completely inserted condition.

Referring to FIG. 7, the pair of the pressure blades 30 are moved into the insertion space 24 and contact the upper insulation layer 37 of the flexible flat cable 4, thereby depressing the end portion thereof. This causes the downward deflection of each of the pair of terminals 2 to store the repulsive force. In addition, flat conductors 38 on the flexible flat cable 4 are resiliently held between the pressure blades 30 and the contact portion 14 of the terminals 2, thereby completing an electrical circuit.

Referring to FIG. 8 the lock hole 40 of the flexible flat cable 4 becomes engaged with the projection 18 of the lock plate 15 at this time. The flexible flat cable 4 is anchored on the vertical wall 21 and the support blade 34 of the connector cover 3 is positioned under the lock plate 15. Therefore, the support blade 34 serves to support the lock plate 15 from the under side and to prevent the downward deflection thereof. In this completely inserted condition, the lock plate is substantially horizontally held so that the flexible flat cable 4 is horizontally positioned thereon.

In this arrangement detachment of the flexible flat cable 4 from the electrical connector is eliminated. Therefore, the electrical connector according to the present invention is extremely useful when used with movable parts. More specifically, it is possible to achieve such an effect by simply inserting the flexible flat cable 4 into the insertion space 24 and then inserting the connector cover 3 into the completely inserted position. No other operations such as insertion of lock pins are necessary.

To disconnect the flexible flat cable 4 from the terminals 2, the connector cover 3 is withdrawn to said insertion start position. The support blade 34 is removed from the under side of the lock plate 15. A suitable tool is entered into a release window 25 to downwardly deflect the lock plate 15. The projection 18 is released from the lock hole 40 and finally the flexible flat cable 4 is pulled out.

It is to be understood that although in the embodiment of the electrical connector as stated above, the electrical connection of two flat conductors of the flexible flat cable with two terminals has been described by way of example. A greater or lessor number of flat conductors and terminals may be selected according to the application of the electrical connector. Similarly in the embodiment as stated above, the terminals 2 have been described as connected to the lead wire 10, but the terminals may be connected to conductors on a printed circuit board.

What is claimed is:

1. An electrical connector for a flexible flat cable comprising a connector housing having a plurality of terminals arranged therein at predetermined intervals parallel to one another, and a connector cover removably mounted on said connector housing and having a pressure blade capable of being inserted into a space defined between an undersurface of an upper wall of said connector housing and a contact portion of each terminal, said flexible flat cable having a plurality of flat conductors arranged thereon at the predetermined intervals parallel to one another designed to be inserted through an insertion port of said connector cover into said space, said pressure blade of the connector cover being laterally moveable into a completely inserted position within said space so that said pressure blade of the connector cover displaces each terminal, thereby resiliently holding said flat conductors on said cable between said contact portion of each terminals and said blade and electrically connecting said flat conductors and in said contact portions of said terminals, characterized in that;

said flexible flat cable is processed to have a lock hole between said flat conductors thereon;

a lock plate having a projection on a free end thereof is mounted between said terminals in said connector housing so that said projection of said lock plate is fit into said lock hole of said flexible flat cable at said completely inserted position; and a support blade mounted at the position under said pressure blade of said connector cover and at the same level as that of said lock plate for abutting and preventing the downward deflection of said lock plate at said completely inserted position.

2. An electrical connector for a flexible flat cable according to claim 1 in which the length of said support blade is determined in such manner that the downward deflection of said lock plate is permitted when said flexible flat cable is inserted into said insertion space while guiding said flexible flat cable along said projection and said upper surface of the lock plate at an insertion start position of said pressure blade of the connector cover so that said flexible flat cable is resiliently upwardly displaced in response to said downward deflection of said lock plate, thereby enabling temporary holding of said flexible flat cable and said lock plate.

3. An electrical connector for a flexible flat cable according to claim 1 further comprising means for removably mounting said connector cover on said connector housing when said connector cover is pushed into said completely inserted position, said means for removably mounting includes male portions defined on two sides of said connector housing and female portions defined on two sides of the connector cover and capable of mating into said male portions.

4. An electrical connector for a flexible flat cable according to claim 3 further comprising a release window formed on said upper wall of the connector housing at the position corresponding to said lock plate, said release window being used when said connector cover is in said insertion start position to downwardly flex said lock plate, thereby releasing the engagement of the projection of the lock plate with the lock hole of said flexible flat cable.

5. An electrical connector for a flexible flat cable according to claim 4 in which each of said plurality of the terminals is connected to a lead wire.

6. An electrical connector for a flexible flat cable according to claim 4 in which each of said plurality of the terminals is connected to conductors on a printed circuit board.

* * * * *